US006078643A

United States Patent [19]

Vogelsong et al.

[11] Patent Number: 6,078,643

[45] Date of Patent: Jun. 20, 2000

[54] PHOTOCONDUCTOR-PHOTOCATHODE IMAGER

[75] Inventors: Thomas Lee Vogelsong, Jamesville; Robert M. Iodice, Syracuse, both of N.Y.

[73] Assignee: Infimed, Inc., Liverpool, N.Y.

[21] Appl. No.: 09/074,103

[22] Filed: May 7, 1998

[51] Int. Cl.[7] ..... H01J 29/36

[52] U.S. Cl. ..... 378/98.2; 258/214 VT

[58] Field of Search ..... 378/98.2, 98.3, 378/98.6, 98.8; 250/207, 214 VT, 370.01, 591; 313/103 CM, 105 CM

[56] References Cited

U.S. PATENT DOCUMENTS

| | | | |
|---|---|---|---|
| 3,784,831 | 1/1974 | Reif | 250/214 VT |
| 4,413,280 | 11/1983 | Alderstein et al. . | |
| 4,471,378 | 9/1984 | Ng . | |
| 5,195,118 | 3/1993 | Nudelman et al. . | |
| 5,532,475 | 7/1996 | Tonami et al. | 250/214 VT |
| 5,543,862 | 8/1996 | Culkin . | |
| 5,567,929 | 10/1996 | Ouimette . | |
| 5,739,522 | 4/1998 | Ouimette | 250/214 VT |

FOREIGN PATENT DOCUMENTS

| | | |
|---|---|---|
| 0600476 | 8/1994 | European Pat. Off. . |
| 2080244 | 12/1971 | France . |
| 63-105439 | 10/1988 | Japan . |
| WO 9301612 | 1/1993 | WIPO . |
| WO 9626534 | 8/1996 | WIPO . |

OTHER PUBLICATIONS

Photocathode Displays/Author Brad Culkin. Information Display Aug. 1997, pp. 14–17.

*Primary Examiner*—David P. Porta
*Attorney, Agent, or Firm*—Harter, Secrest & Emery LLP; Stephen B. Salai, Esq.; Brian B. Shaw, Esq.

[57] ABSTRACT

A high resolution radiation sensitive imager includes a radiation sensitive photoconductive target for forming an image in response to incident radiation, a light sensitive cathode arranged in spaced apart relationship with the target, and an addressable light source coupled to the photocathode for causing the photocathode to emit electrons at localized sites for reading an image on the target.

44 Claims, 12 Drawing Sheets

PHOTOCONDUCTOR-PHOTOCATHODE IMAGER

FIELD OF THE INVENTION

This invention relates in general to radiation sensitive imagers, and more particularly to a high-resolution flat panel x-ray imaging system.

BACKGROUND OF THE INVENTION

A variety of approaches have been used for x-ray imaging. X-ray film is perhaps the most basic approach. X-ray film provides reasonable resolution, and has a compact form factor, but does not provide real time imaging. The film must be exposed and then developed before the image can be viewed. The developing process uses environmentally hazardous chemicals, and the exposure, develop, analysis cycle must sometimes be repeated several times before the desired image is created. In addition, the detection efficiency of x-ray film is less than ideal for many applications.

X-ray image intensifiers can be combined with television cameras to provide real time imaging, but they are bulky and have limited resolution.

Computed radiography has a small form factor, and electronic readout, but the resolution and detection efficiency are low and computed radiography does not provide fast readout.

There is a need for flat panel x-ray detectors, both direct and indirect sensing types, and a variety of such detectors are presently in development which overcome many of the limitations just mentioned, but have not achieved acceptable electronic noise and resolution performance.

One approach presently being developed uses an electron beam to read out an image stored on an x-ray sensitive photo-conductive target. Devices of this type are described in U.S. Pat. No. 5,195,118. The target is first charged to a uniform negative potential, for example by scanning it with the electron beam. Incident x-rays cause localized discharge to form a latent image on the target. As long as the target resistivity is high enough, the charge pattern representing the image will remain spatially localized.

The image is read by scanning the target with the electron beam in raster fashion. This serves the purpose of both recharging the target to its initial potential and creating a current signal proportional to the latent charge image. The current flowing in the electron beam is then sensed by an output amplifier. As the electron beam is scanned across the target, the amplifier produces a video signal representing the latent image on the target. Target materials can be produced that have very high spatial resolution. The overall resolution of the detector is limited by the size and shape of the electron beam.

An alternative approach also utilizing a photoconductive target uses an array of cold cathode field emitters of the type used in field emitter displays to supply an addressable source of electrons. Detectors, using such emitters, are described in U.S. Pat. No. 5,567,929. The resolution achievable by this approach is limited by the shape of the electron beam created as electrons leave the hemispherical tip of the elements of the cathode. In field emitter based displays, the beam can be narrowed by utilizing a high voltage anode, or by placing the display phosphor (in a field emitter display) close to the cathode. These approaches are not applicable to imagers using photoconductive detectors, because the landing velocity of the electrons must be small, thus preventing a high voltage from being used, and the target layer must be spaced farther away from the emitter layer to reduce output noise. Output noise is proportional to the capacitance, and the capacitance is inversely proportional to the distance between the target electrode and all other physical structures in the imager. In order to create a high speed scanned system, a large beam current is required in order to recharge each picture element of the target during the time the beam impinges on that pixel. Field emitter arrays typically have current limiting resistors and/or exhibit large variations in current from tip to tip, due to process non-uniformities. This limits the beam current, and therefore limits the readout speed achievable with field emitters. Other problems make this approach difficult, including the need for the addressable array of field emitters to be inside a vacuum envelope. The addressing circuitry that drives each row and senses each column must be outside the envelope, and this creates the need for many electrical feed throughs into the vacuum envelope, introducing manufacturing difficulties. Moreover, the device cannot be completely tested until it is assembled in the vacuum envelope.

There is a need for an x-ray imager that overcomes the disadvantages of the prior art. More specifically, there is a need for an imager that has a small form factor, that is, an imager that is approximately as thin and flat as an x-ray film cassette, has electronic readout as opposed to film which must be scanned to provide digital images, has a wide dynamic range (1000:1) and has a high detection efficiency (50%). For fluoroscopy, the imager has low electronic noise, below the quantum noise of the x-ray image and fast readout (at least 30 frames per second). For radiographic imaging the imager has high resolution (>5 lp/mm).

It is an object of this invention to provide a high resolution flat panel imager for x-ray or other radiation sources that overcomes the disadvantages of the imagers just discussed, and provides the characteristics just mentioned.

BRIEF DESCRIPTION OF THE INVENTION

Briefly stated, and in accordance with one aspect of the invention, a high resolution radiation sensitive photoconductor-photocathode imager (PPI) includes a radiation sensitive photoconductive target for forming an image in response to incident radiation, a light sensitive cathode arranged in spaced apart relationship with the target, and a light source optically coupled to the photocathode for causing the photocathode to emit electrons for addressably reading an image on the target.

In accordance with another aspect of the invention, an accelerating electrode is placed between the light sensitive photocathode and the radiation sensitive photoconductive target for the purpose of directing the electrons emitted by the photocathode toward the photoconductor.

In accordance with another aspect of the invention, the photoconductive target comprises a radiation transmissive substrate and a layer of radiation sensitive photoconductive material on the substrate.

In accordance with another aspect of the invention, the radiation sensitive material is one of selenium, thallium bromide, thallium iodide, lead iodide, lead bromide and the like.

In accordance with yet another aspect of the invention the radiation sensitive material is a layered combination consisting of a first layer of scintillator material such as cesium iodide (CsI) or terbium activated gadolinium oxysulfide (Gd2O2S:Tb) and a second layer of photoconductor compatible with the output wavelength of the scintillator such as lead iodide (PbI) or antimony trisulphide (SbS3).

In accordance with another aspect of the invention, the photocathode comprises a material that has a good quantum efficiency such as a layer of antimony combined with an alkali metal such as sodium, potassium or cesium or any other alkali like material such as cesium compounds, a cesium silver oxide compound, and the like.

In accordance with a further aspect of the invention, the light source comprises a two-dimensional monochrome display, such as a liquid crystal display, field emission display, electroluminescent display, plasma flat panel display, a cathode ray tube or any light source capable of providing uniform illumination on the photocathode.

In accordance with another aspect of the invention, addressably reading an image includes any combination of row and column addressing. Each of the row and column addressing comprises any one of a segmented target electrode, a segmented photocathode electrode, a segmented light source, a segmented mesh electrode or mechanical translation.

In accordance with another aspect of the invention, the light source comprises a single line of high resolution light sources and means for mechanically translating the light sources relative to the photocathode.

In accordance with another aspect of the invention, a radiation sensitive target comprises a line of radiation sensitive photoconductive material and the imager includes means for scanning the image relative to the target for forming the image sequentially, line by line.

In accordance with still another aspect of the invention, the light source may be one or more scannable lasers.

In accordance with another aspect of the invention, the photoconductive target is divided into a plurality of segments that can be read in parallel to increase image read-out rate.

In accordance with another aspect of the invention, resolution is improved by providing a light source that is larger than the photocathode, and providing optical imaging means for imaging the light source on the photocathode.

The novel aspects of the invention are set forth with particularity in the appended claims. The invention itself, together with further objects and advantages thereof may be more readily comprehended by reference to the following detailed description of the presently preferred embodiment of the invention, taken in conjunction with the accompanying drawings, in which:

DETAILED DESCRIPTION OF THE PREFERRED EMBODIMENT

Figure 1:
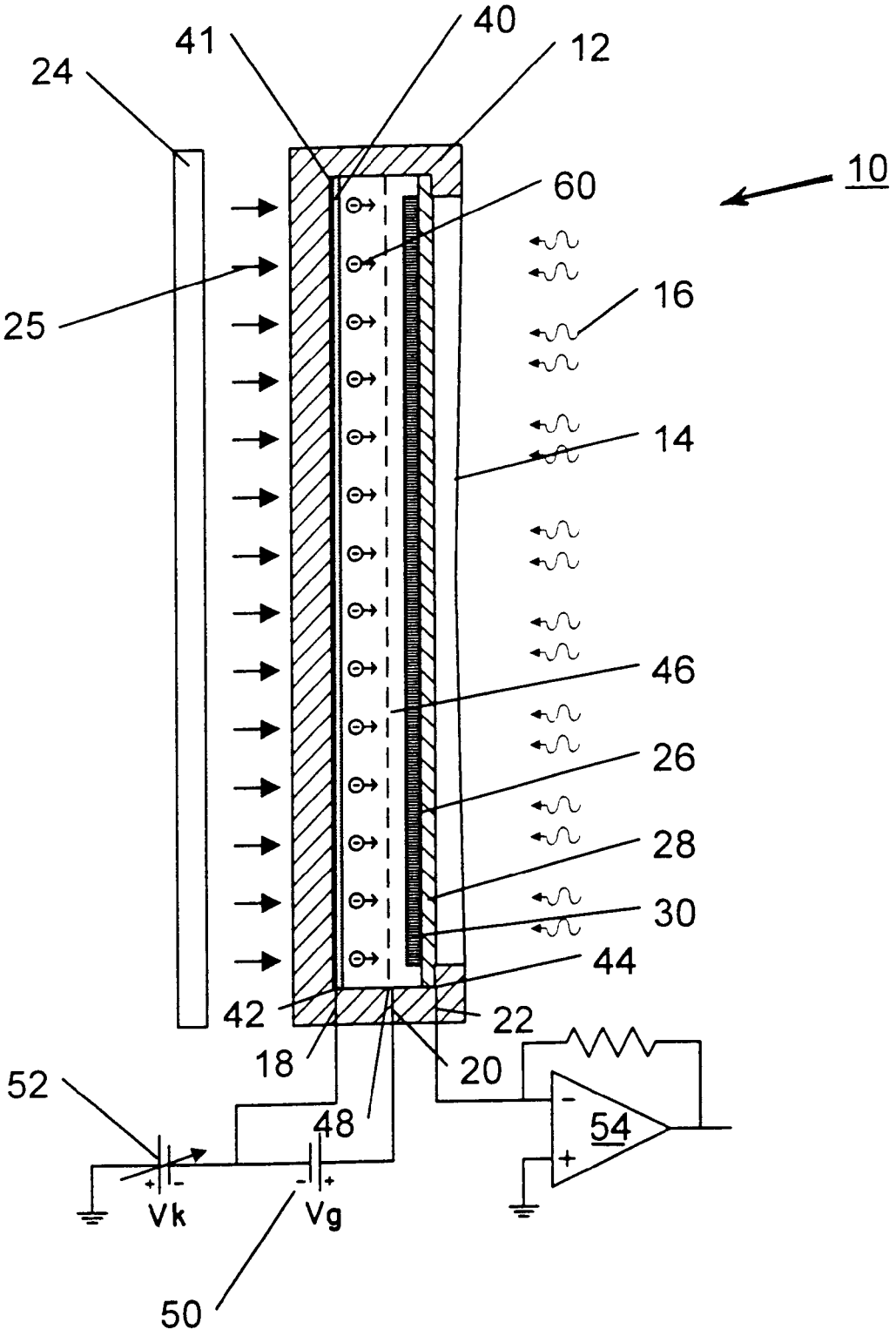
FIG. 1 is a diagrammatic view of a cross section of a high resolution flat panel x-ray imager in accordance with the invention.

Referring now to FIG. 1, the imager, indicated generally at 10 includes a glass envelope 12 within which a vacuum can be maintained. The envelope includes an x-ray window 14, through which x-rays 16 for forming the image will pass. An envelope body supports the x-ray window and includes feed throughs 18, 20, 22 for making electrical connections to elements of the detector within the envelope, as will be described.

An addressable light source 24 is disposed adjacent to but preferably separate from the envelope 12. While the preferred embodiment includes a row addressable light source, and a column addressable target as described in more detail below, the invention includes all combinations of addressable: targets, light sources, photocathodes, meshes and mechanical translations that permit addressable reading of a target to produce an image consisting of an array of pixels. Preferably, the photocathode and photoconductor of this invention are segmented, when desired, by segmenting the electrode upon which the photocathode or photoconductor is formed.

While the preferred embodiment of the invention includes a light source disposed outside a vacuum envelope, the invention includes other embodiments such as a light source within the vacuum envelope.

A radiation sensitive photoconductive detector 26 is formed on the inside of the x-ray window 14. Preferably, the detector includes a radiation (x-ray) transmissive substrate 28 having a layer of photoconductive radiation sensitive material 30 formed thereon. Preferably, the substrate is formed from a thin sheet of aluminum, and the photoconductive material is formed from one or more of selenium, thallium bromide, thallium iodide, lead iodide, lead bromide, or any other photoconductive material that is responsive to the radiation being imaged. Although the invention is described in connection with an x-ray sensitive target, targets sensitive to other wavelengths of radiation can also be provided, and will operate in substantially the same way.

A photocathode 40 is formed from a layer of optically sensitive material, that provides a localized stream of electrons in response to light from the light source. Preferably, a layer of antimony combined with an alkaline metal is employed in this embodiment of the invention.

Electrical connections 42, 44 are made to the photocathode and photoconductor substrate by way of feed throughs 18, 22 in the glass vacuum envelope 12. To improve the electrical connection between photocathode 40 and voltage source 52, a transparent electrode 41 such as indium tin oxide (ITO) is disposed between photocathode 40 and glass envelope 12.

Preferably, a mesh accelerating electrode 46 is disposed in the space between the photocathode 40 and the detector 26 for accelerating electrons generated by the photocathode toward the detector. An electrical connection 48 to the accelerating electrode is also formed through the envelope. The accelerating electrode 46 is connected to a source 50 of accelerating potential through electrical connection 48 to accelerate electrons from the photocathode 40 towards the accelerating electrode 46, and then to cause the electrons to decelerate prior to landing on the x-ray sensitive photoconductor 30. A low electron velocity at impact is preferred in accordance with this invention.

A voltage source 52, preferably a variable voltage source establishes a potential between the photocathode 40 and the x-ray sensitive photoconductor 26. Preferably, the voltage source 52 is connected between the photocathode 40, preferably the rear surface of the photocathode relative to the target, and ground.

A video amplifier 54, which is preferably a differential amplifier is connected between the target substrate 28, preferably the outside surface of the target substrate relative to the photocathode, and ground.

Figure 2:
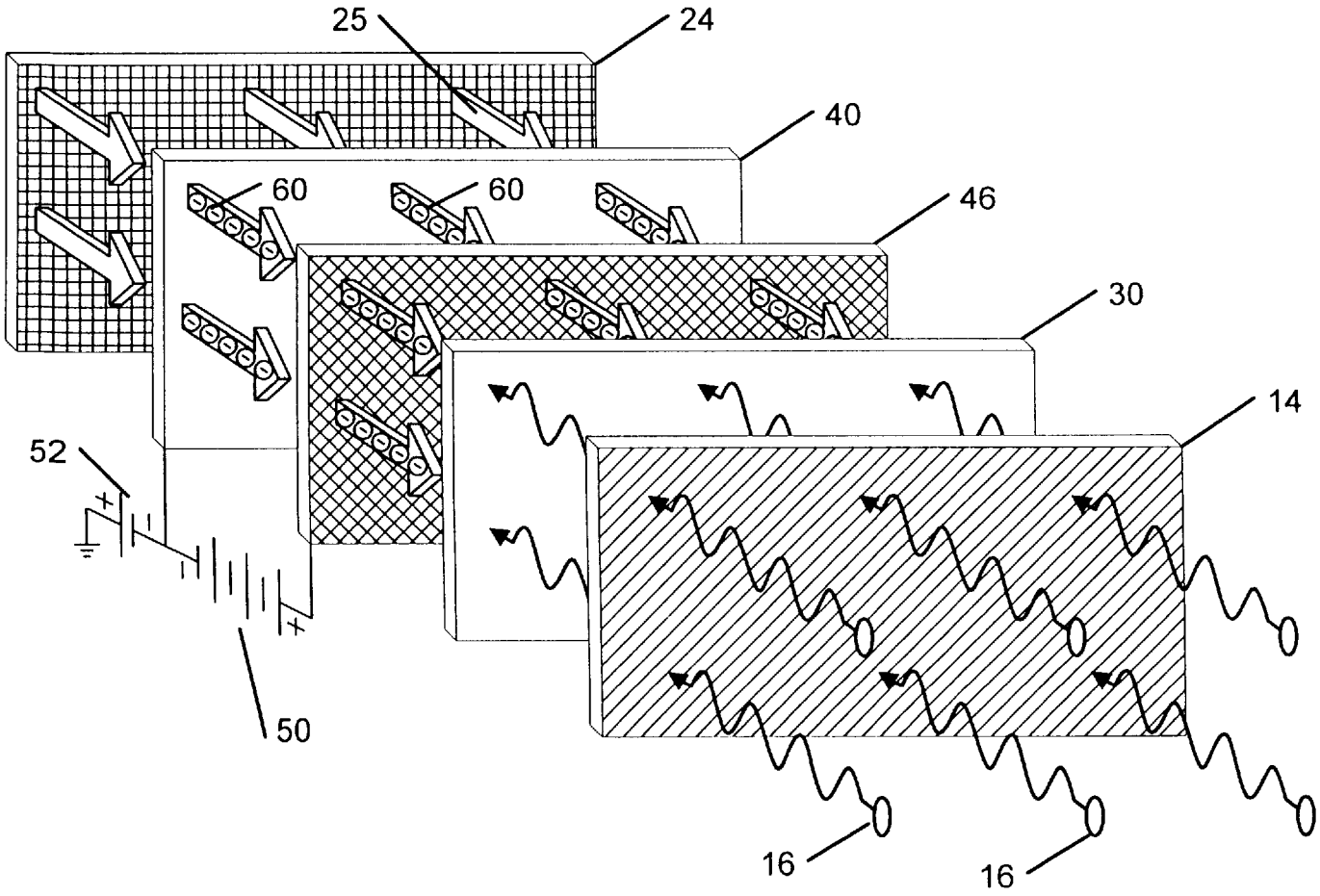
FIG. 2 is a diagrammatic exploded view of an imager in accordance with the invention.

FIG. 2 shows a diagrammatic exploded view of an x-ray imager in accordance with this invention. The imager includes a monochrome two-dimensional addressable light source 24 that is preferably located outside a vacuum envelope. A photocathode 40 is disposed within the vacuum envelope and emits a plurality of electron beams 60 in response to localized illumination 25 from the light source. An x-ray sensitive photoconductor 30, also within the vacuum envelope, is disposed in spaced apart relationship with the photocathode and a mesh electrode 46 is disposed therebetween. An x-ray window 14 that is transparent to x-rays is disposed on the opposite side of the x-ray sensitive photoconductor from the photocathode. X-rays 16 passing through the x-ray window 14 impinge on the x-ray sensitive photoconductor 30, and locally alter the charge on the photoconductor. Electrons 60 accelerated from the photocathode towards the x-ray sensitive photoconductor by the mesh electrode, and then decelerated to reduce their velocity at the photoconductor, create a current that varies with the quantity and energy of the x-ray photons absorbed at each local area of the photoconductor.

A first potential source 52 is connected between the photocathode and ground, and a second accelerating potential source 50 of opposite polarity is connected between the photocathode and the mesh electrode. The video amplifier which is connected to the x-ray sensitive photoconductor, preferably to the surface thereof adjacent to the x-ray window, is shown in FIG. 1 and omitted from this figure for clarity.

Figure 3:
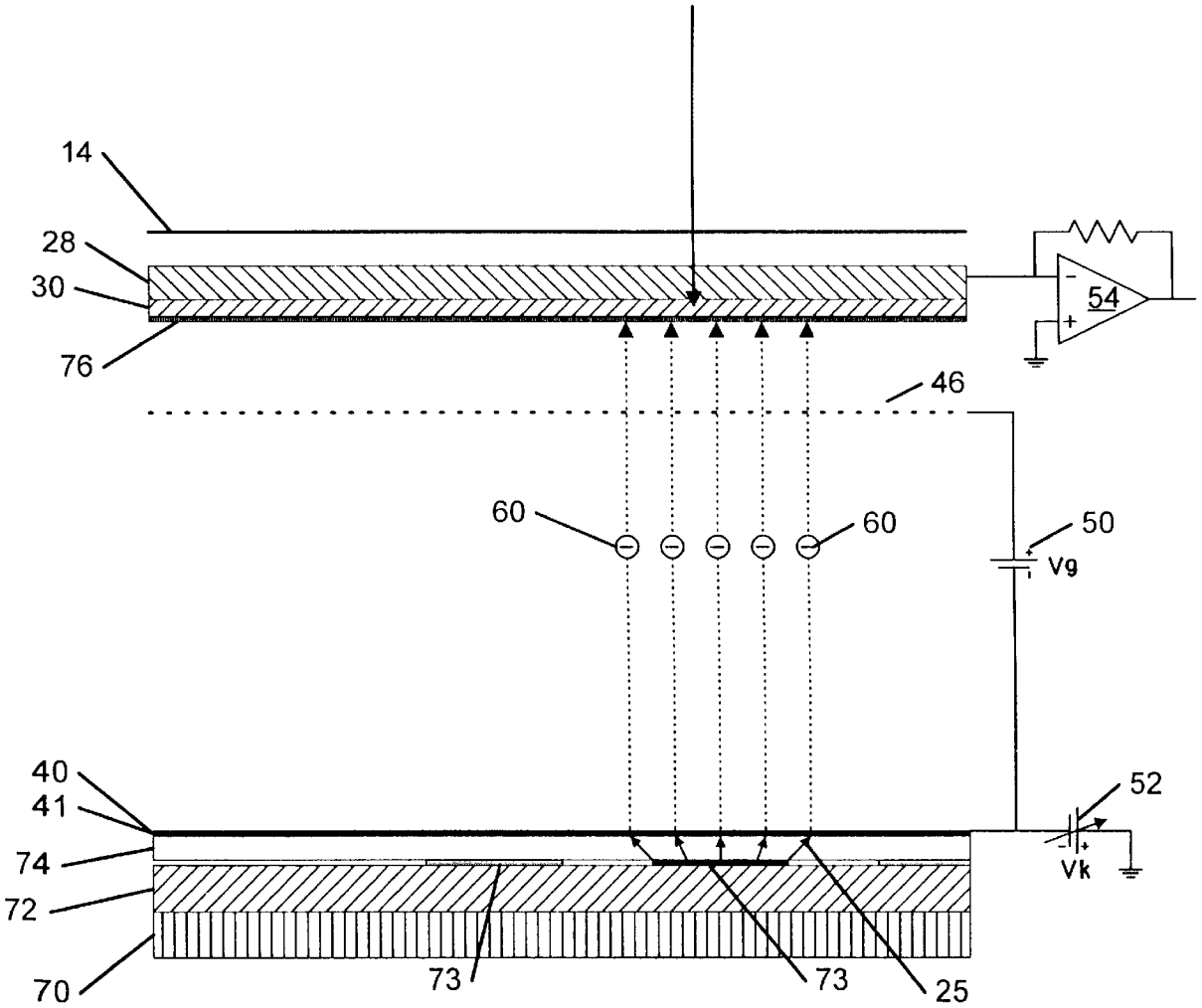
FIG. 3 is a detailed cross sectional view of the imager of FIG. 1.

FIG. 3 is a detailed cross sectional view of an imager in accordance with this invention. An exemplary electroluminescent display includes an aluminum column electrode 70, an electroluminescent phosphor 72 and a transparent row oriented electrode 73 arranged in a layered relationship. The light source is positioned adjacent to a thin glass plate 74 forming the back wall of the vacuum envelope. The transparent electrode 41 is formed as a layer on the thin glass plate and is connected to the negative terminal of the voltage source 52 which is connected to ground. The photocathode 40 is formed as a layer on the transparent electrode 41. Light emanating from the electroluminescent phosphor 72, is transmitted through the glass vacuum envelope 12 and transparent electrode 41 and is absorbed in photocathode 40, liberating electrons 60.

An accelerating electrode, preferably mesh layer 46 is positioned between the photocathode 40 and the photoconductor layer 30. An accelerating voltage is provided by voltage source 50 which is connected between the photocathode and the mesh electrode. Electrons 60 are accelerated towards the electrode 46 and then decelerate as they approach the target 30. The target includes an x-ray transmissive substrate 28, preferably aluminum layer, on which the photoconductor target is formed. Preferably, the vacuum surface of the photoconductor 30 is coated with an anti-secondary emission coating 76 for maintaining the resolution of the imager.

A video amplifier 54 is connected to the substrate 28, preferably the outside surface of the substrate relative to the photocathode.

Figure 4:
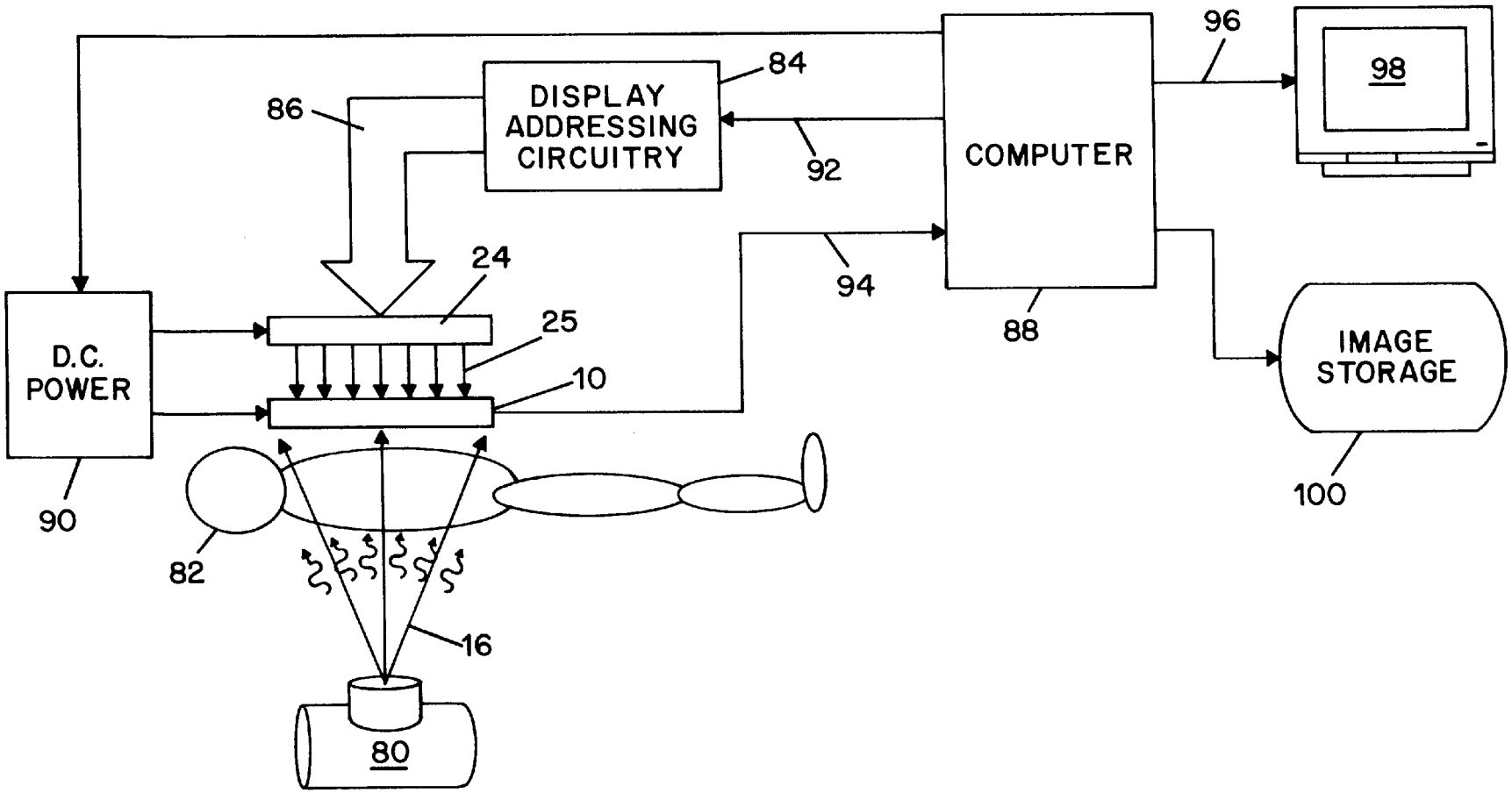
FIG. 4 is a block diagram of an imaging system in accordance with the invention.

An overall block diagram of an imager in accordance with this invention is shown in FIG. 4. A conventional x-ray source 80 is positioned on one side of a body 82 to be imaged. The detector 10 of this invention is disposed on the opposite side, so that x-rays 16 passing through the body impinge on the x-ray sensitive photoconductor. A two-dimensional addressable monochromatic light source 24 is disposed adjacent to the imager, so that light from the light source impinges on the rear surface of the imager, and then upon the photocathode. A display addressing circuit 84 provides addressing information to the display by way of a multiline data bus 86 for illuminating the individual pixel elements thereof.

Image processing electronics, such as a microcomputer 88, outfitted with appropriate hardware and software for image handling, provides control signals to a DC power source 90 that provides the accelerating potential and target voltages shown and described in connection with FIGS. 1 and 2. The computer 88 also provides timing and control signals to the display addressing circuitry by way of signal bus 92, and receives and synchronizes the video output 94 from the imager. The computer 88 provides real time video signals 96 to a monitor 98 on which the image may be observed by an operator, and at the same time provide a signal to an image storage system 100, such as a non-volatile disk or the like.

The photocathode produces electrons in proportion to the intensity of the light striking it from the light source. The shape of the electron beam produced by the photocathode provides a much higher resolution than can be produced by field emitters. An article by Culkin (Information Display 8/97) describes the advantages of photocathode emitters vs. field emitters. In this article Mr. Culkin is comparing photocathode displays and field-emission displays but the comments are equally valid to sensors based on these types of electron sources. The field-emission process uses high electric fields to extract electrons. The high field is produced by focusing an extraction potential of about 100 V at the tip of a micro-electrode. The tip of the electrode is roughly hemispherical, and the high-field region extends over this half sphere.

Electrons extracted by this field emerge at a velocity equivalent to about one-fourth the extraction potential, i.e., at about 25 eV, in the direction of the extraction field. Since the electric-field lines near the tip are everywhere normal to the half sphere, the field-emitted electrons spray in all directions normal to the half sphere. They have parabolic trajectories instead of trajectories that are straight lines across the gap, as occurs in a photocathode image intensifier. More precisely, there is beam spreading in both PCDs [photocathode displays] and FEDs [field emission displays] because of randomly directed electron emission, but the spreading in PCDs is only one-hundredth of that found in FEDs.

In fact, the resolution of the electron beam produced by a photocathode in accordance with this invention does not limit the resolution of the radiation sensitive photoconductor, and resolutions as high as 70 lp/mm can be achieved.

These resolutions are well in excess of the requirements for high resolution imaging applications such as mammography or microangiography, which require resolutions in the 10–20 lp/mm range.

Moreover, the photocathode is much simpler to manufacture than a field emitter, since micro tips need not be formed, and the beam current limitations of field emitters are overcome since there are no current limiting resistors, and the output from the flat photocathode is uniform.

The addressing of the photocathode is carried out by the light source which can be entirely outside the vacuum envelope, thus dramatically reducing the number of feed throughs that must be provided in the envelope.

Figure 5:
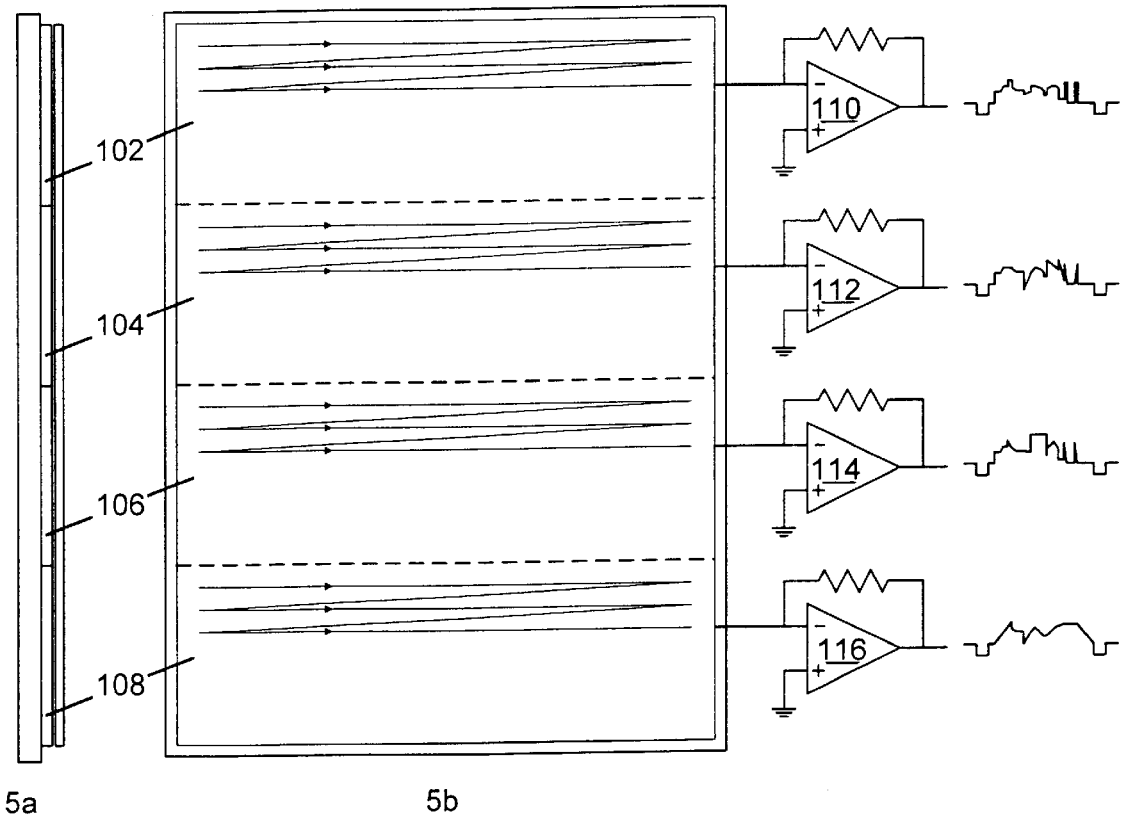
FIG. 5 is a diagrammatic view of a multi-segment parallel read-out imager in accordance with the invention.

FIG. 5 shows the target of an x-ray imager in accordance with this invention wherein the target electrode has a plurality of segments that can be read out in parallel. This greatly improves the speed at which the image can be read, and permits large area high read-out speed detectors to be fabricated. This also reduces the capacitance of each target segment thereby improving the signal to noise characteristics of the captured image. The x-ray sensitive photoconductor is divided into four parallel regions by dividing the target contact layer into four electrically isolated areas 102, 104, 106, 108, to which individual contact can be made. The arrangement is shown in side view in FIG. 5A and in plan view in FIG. 5B. Four video amplifiers 110, 112, 114, 116 are connected, one to each segment of the target contact. By addressing the light source to provide simultaneous scanning signals on four, not necessarily isolated, areas of the photocathode, the photoconductor can be scanned in approximately one fourth the time that would be needed to scan the entire photoconductor layer in one raster. The outputs of the four video amplifiers can be conveniently multiplexed in the computer to provide an image to the monitor and to the image storage device.

Figure 6:
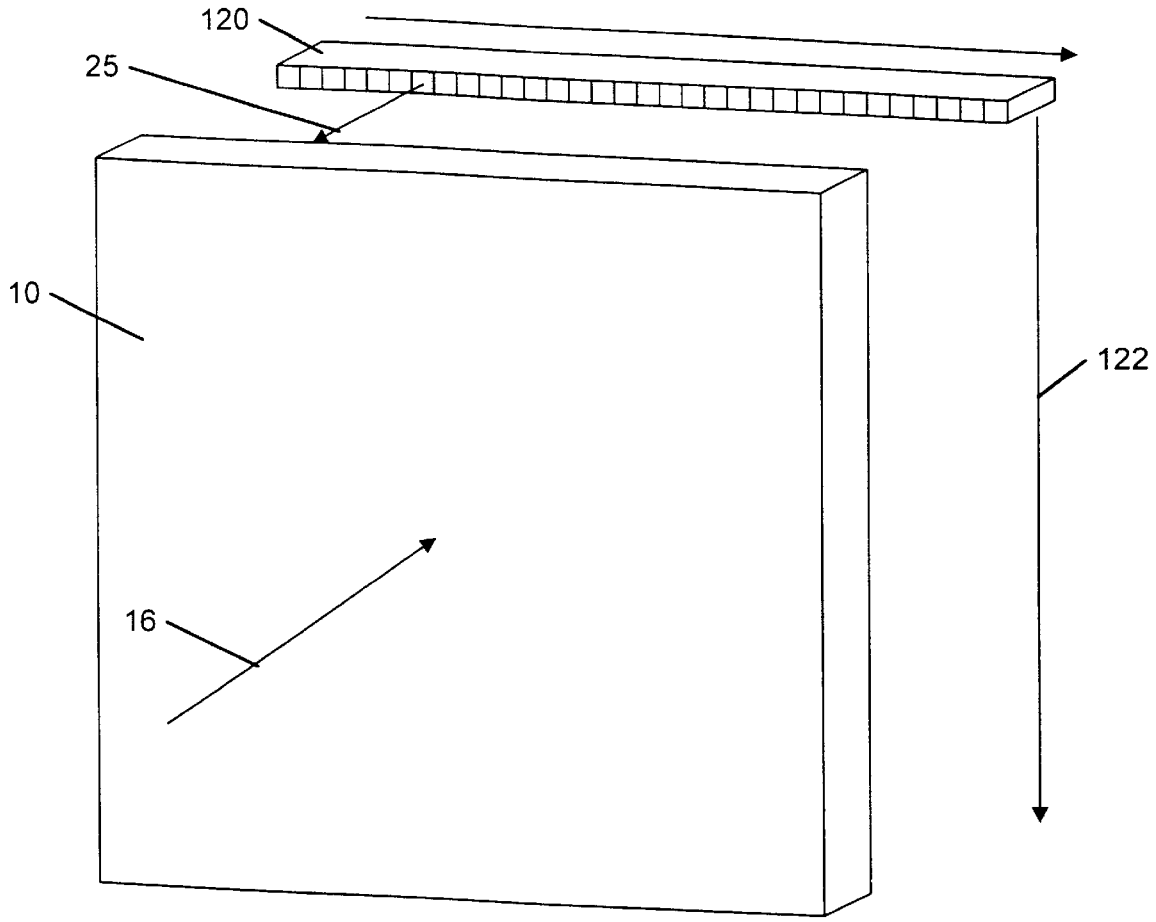
FIG. 6 is a diagrammatic view of an embodiment of this invention having a linear light source.

FIG. 6 shows an imager in accordance with another aspect of this invention. A high resolution single line light source 120 is provided. Preferably, high resolution light emitting diodes are arranged in linear array. A scanning mechanism is provided for translating the array along line 122, relative to the photocathode 10, achieving a very high resolution image at low cost.

Figure 7:
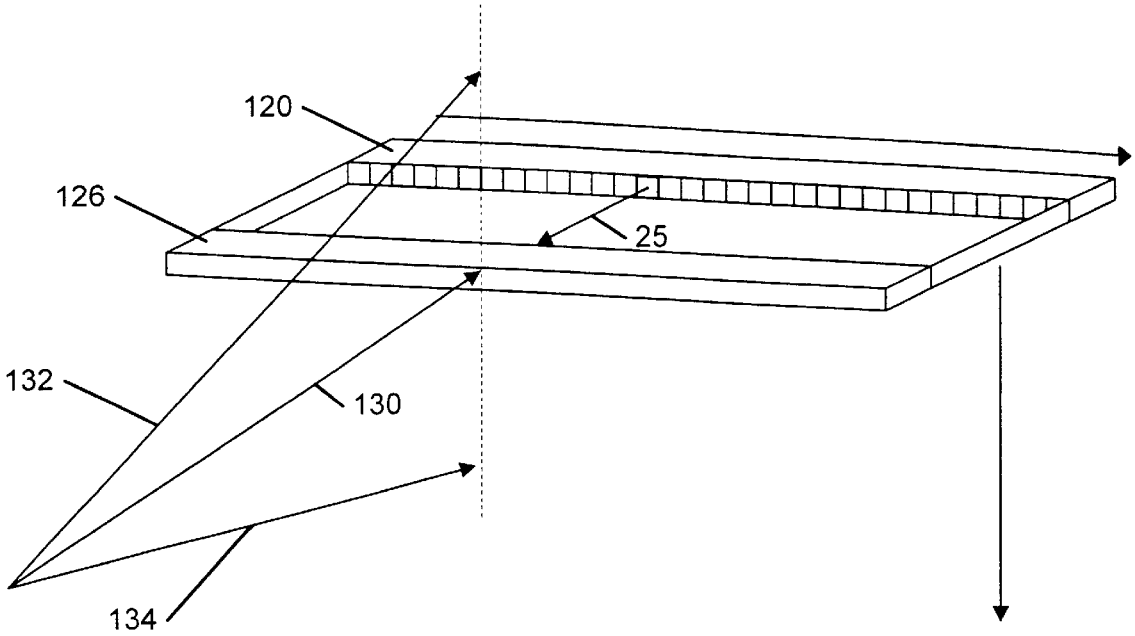
FIG. 7 is a diagrammatic view of a single line imager in accordance with the invention.

FIG. 7 shows a single line imager that can be used where low cost is particularly important. The entire imager could then be scanned relative to the x-ray source for creating the image. The imager includes a single line x-ray sensitive photoconductor and a light source photocathode disposed in a long thin evacuated envelope 126. A one pixel high, multipixel wide light source 120 is coupled to the light sensitive photocathode and the pixels of the light source are preferably sequentially illuminated from left to right, for example, one after another. A single line of video images produced at the x-ray sensitive photoconductor layer in substantially the same manner as has already been discussed.

The linear imager is less expensive than a two dimensional imager, and has the additional advantage of discriminating against scattered x-rays produced during imaging. Ordinarily, the imager can be positioned so that only direct x-rays 130 from the body to be imaged impinge on the x-ray sensitive photoconductor with scattered x-rays 132, 134 falling above or below the x-ray sensitive portion of the imager. This will be most effective with a fan beam source of x-rays.

Figure 8:
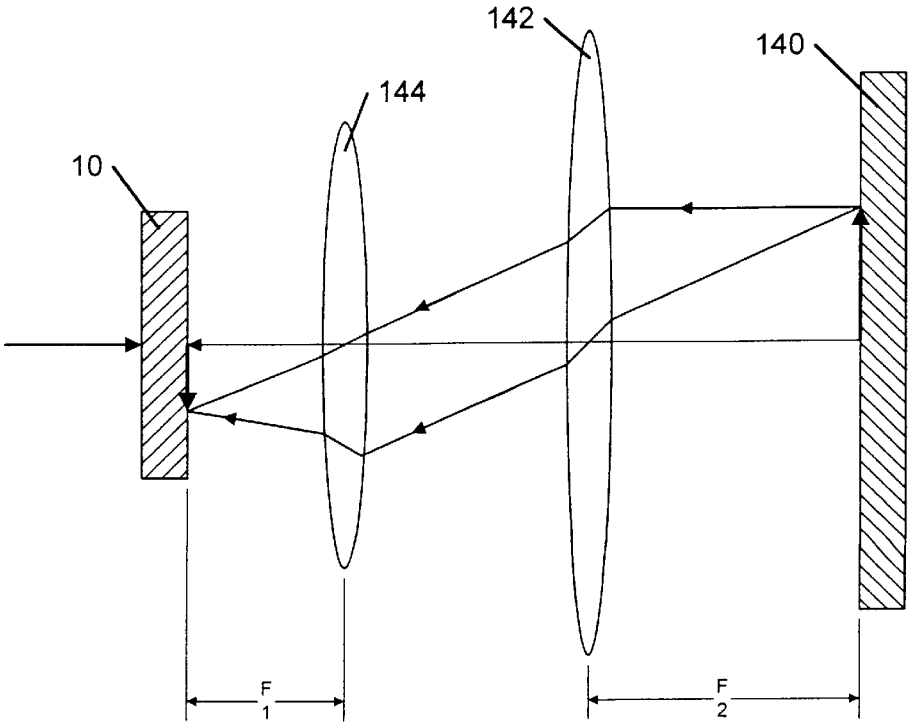
FIG. 8 is a diagrammatic view of an embodiment of the invention having an oversized light source.

FIG. 8 shows an embodiment of the invention in which the resolution is enhanced by providing a two-dimensional light source that is larger than the imager, together with optics for focusing the light from the light source on the photocathode. Alternately, a light source smaller than the PPI could be used with optics to magnify it as the cost and performance trade-offs of a particular application would require.

A two-dimensional monochrome addressable illumination source 140 is provided that is four times as large as the light sensitive photocathode in imager 10. First and second glass optics 142, 144, for example, convex lenses having focal lengths F2 and F1 respectively, are provided for focusing light rays from the illumination source 140 to form a virtual image of the light source on the light sensitive photocathode 10. This method may be employed both with two-dimensional imagers and with single line imagers, as described.

Figure 9:
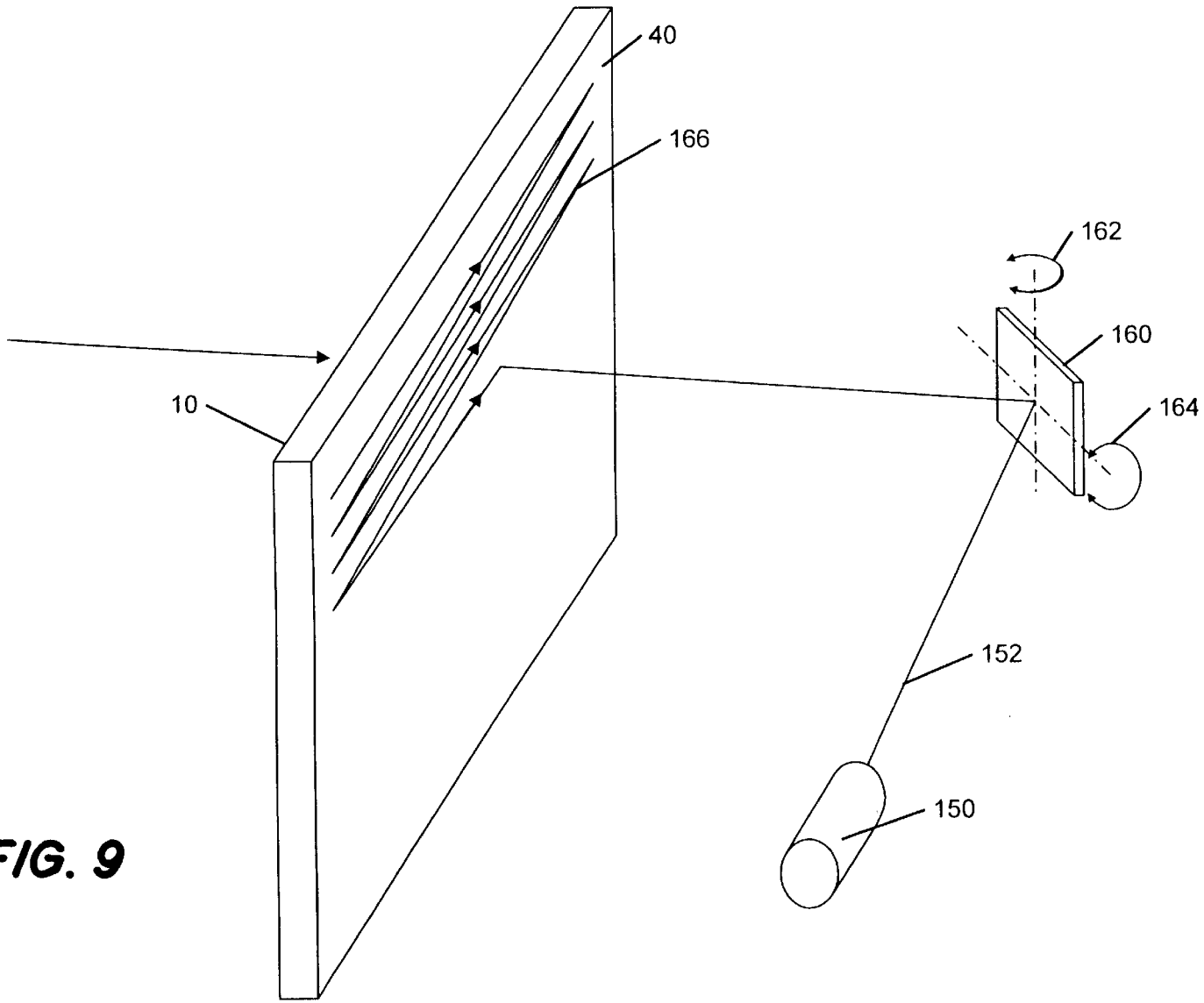
FIG. 9 is a diagrammatic view of an embodiment of the invention having a laser light source.

FIG. 9 shows an embodiment of the invention in which one or more lasers 150 preferably having output wave lengths matched to the sensitivity peaks of the photocathode provide the light source. The laser provides a coherent radiation beam 152 along an axis thereof. The beam impinges on a two-axis scanning mirror 160 having actuators 162, 164 for reflecting the beam, so that it impinges on the light sensitive photocathode of an imager as already described, to form a generally conventional raster 166 of the type used in cathode ray tubes and the like. Preferably, although not shown, vertical and horizontal blanking synchronization would be provided by the computer shown in FIG. 3, or other circuitry of per se known type.

Preferably, the wave length of the laser is matched to the sensitivity of the photocathode, either at or near the peak thereof. However, any wavelength that causes the emission of electrons from the photocathode may be used.

Figure 10:
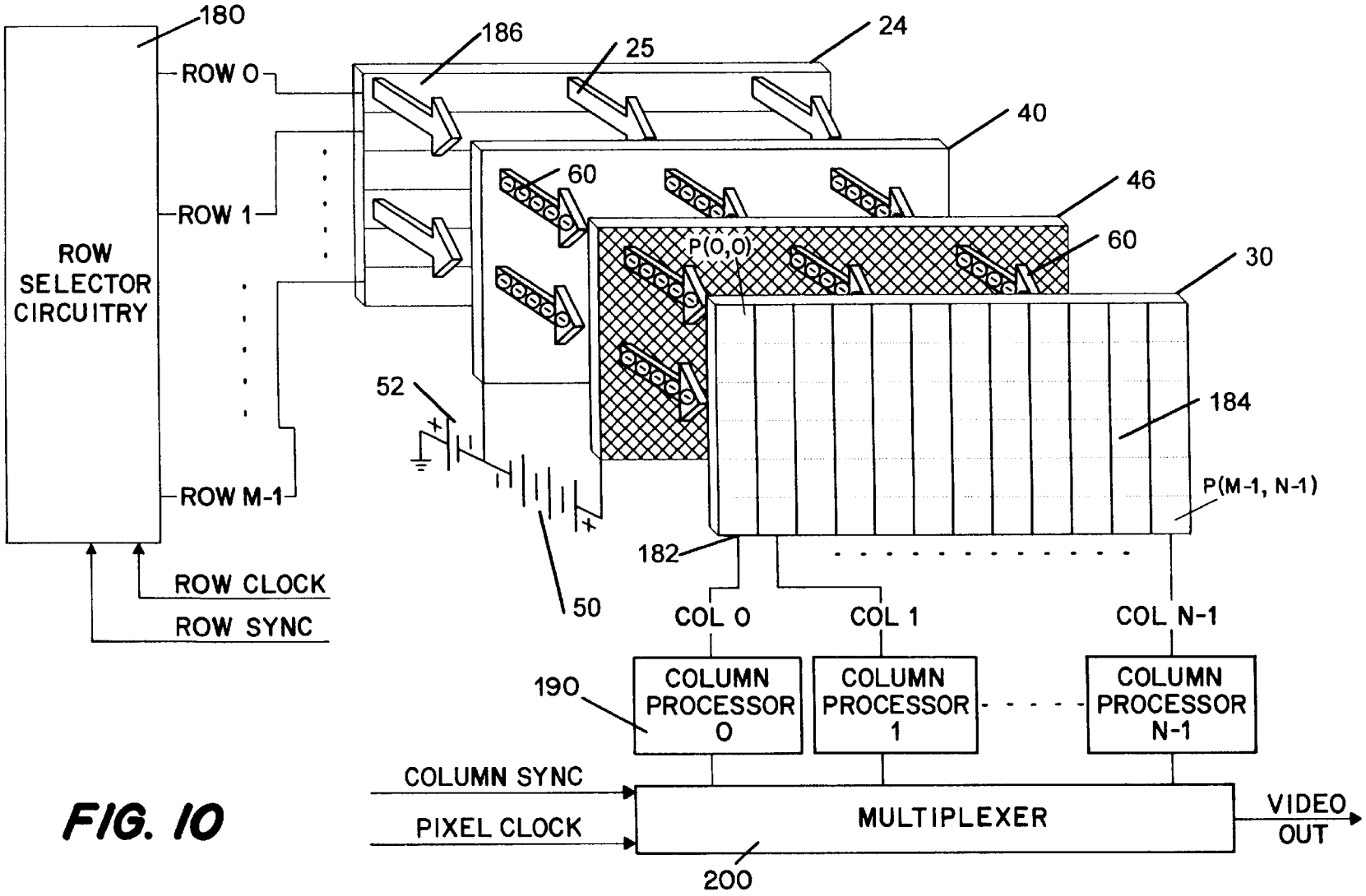
FIG. 10 is a schematic representation of a preferred embodiment of the present invention wherein the target electrode is segmented into a plurality of individual column oriented electrodes.

FIG. 10 shows a diagrammatic view of a preferred embodiment of the invention in which the target 26 is segmented into a plurality of column oriented electrodes 182 (shown in more detail in FIG. 13) labeled as Col. 0 through Col N-1. Likewise, the light source is segmented into a plurality of row oriented segments 186, labeled as Row 0 through Row M 1, and driven by row selection circuitry 180 such that only one row is illuminated at a time. The number of column electrodes and row segments is determined by the desired spatial resolution. For a 20 cm×20 cm to a 23 cm×23 cm image area, 1,024 columns and 1,024 rows are appropriate. Accordingly, the pixels obtained in the acquired image will be approximately 200 to 223 micrometers square. The acquired image is an array of 1,024 by 1,024 pixels. Each pixel of the image corresponds to a pixel of the target 184 and labeled as P(0,0) through P(M-1,N-1). Each of the N column electrodes is attached to a column processor 190 which is an electronic circuit designed to read, integrate and store the image data associated with that column. The multiplexer 200 sequentially connects each of the column processor output signals to a common output point to provide a signal that corresponds to the image data associated with a single row. The process is repeated for each row of the imager. Clearly other imager sizes as well as numbers of rows and columns are possible and desirable depending on the application.

Figure 11:
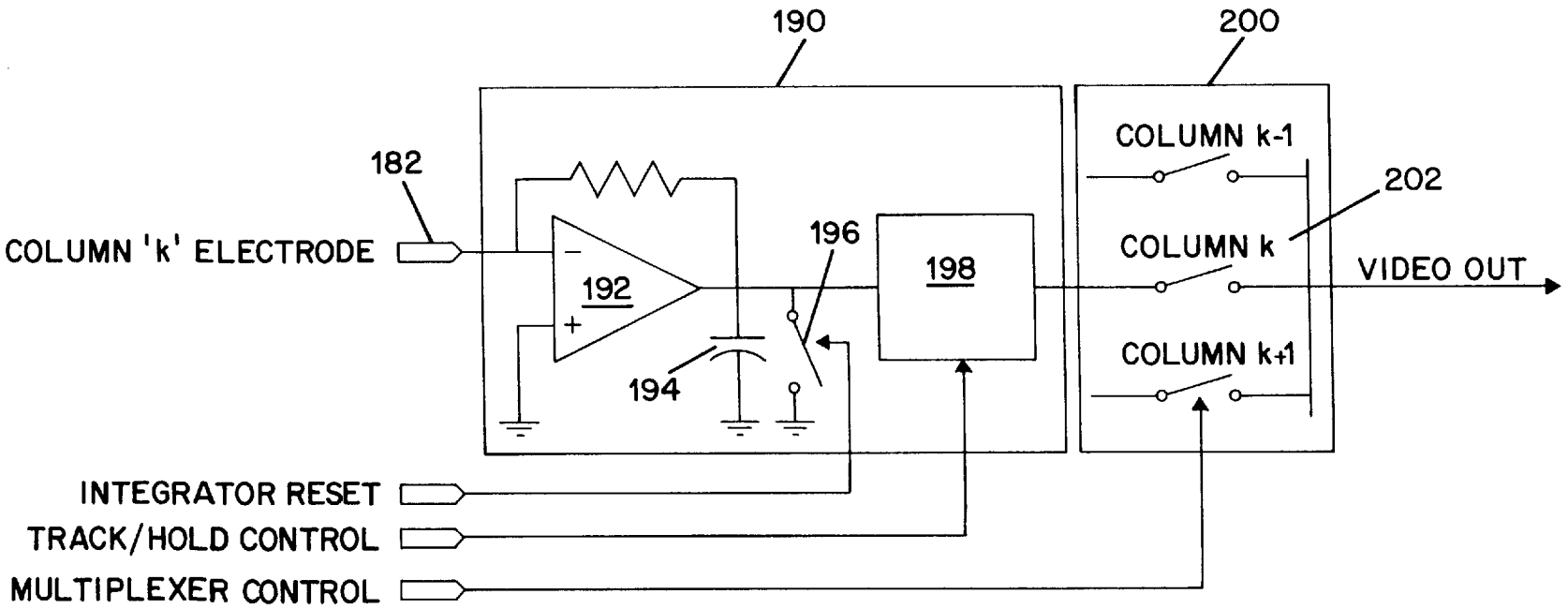
FIG. 11 is a more detailed schematic diagram of one column processor/multiplexer of the embodiment of FIG. 10.

FIG. 11 shows a simplified schematic diagram of a typical column processor circuit 190 and a portion of the multiplexer 200. Each of the column oriented target electrodes is connected to a column processor circuit. The column processor circuit 190 comprises a transimpedance amplifier 192 (also known as a current to voltage converter), an integrating capacitor 194, a reset switch 196 and a sampling circuit 198. The transimpedance amplifier 192 converts the current signal from the column electrode 182 to a voltage across the integrating capacitor 194 thereby integrating the column signal for the duration of almost one line time. (Each frame is equally divided into M lines.) Near the end of the line time, the sampling circuit 198 is activated to effectively copy the voltage across the integrating capacitor 194. Once sampled, the voltage across the integrating capacitor can be discharged by the reset switch 196 to prepare the column processor circuit to repeat the integration process for the succeeding row. With the voltage safely copied by the sampling circuit 198, the image data associated with each of the column processors may be serially transferred to an output pin by the multiplexer 200. In the multiplexer, only one column is connected at a time and each line is equally divided into N columns.

Figure 12A:
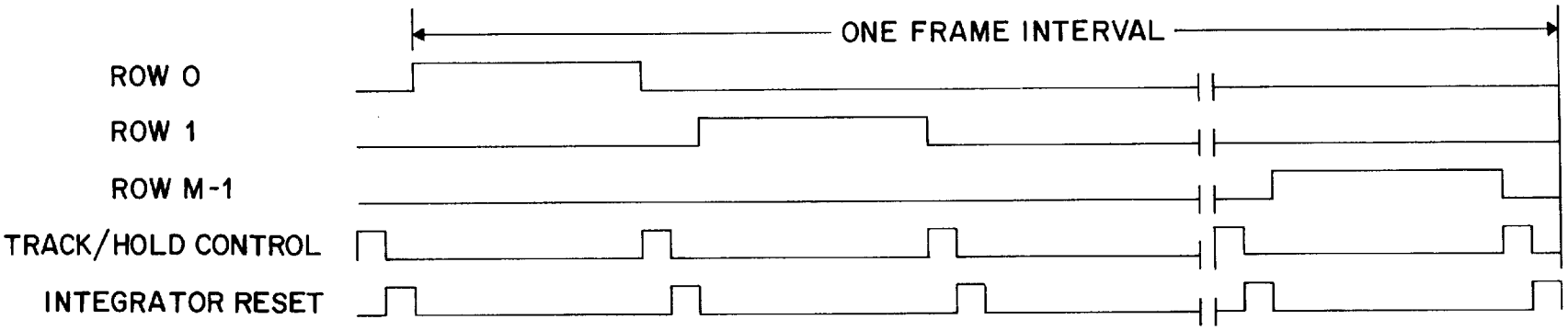
FIG. 12 is a timing diagram showing the signal and control line states of the embodiment of FIG. 10 during a single line and frame readout period in accordance with a preferred embodiment of the present invention.
Figure 12B:
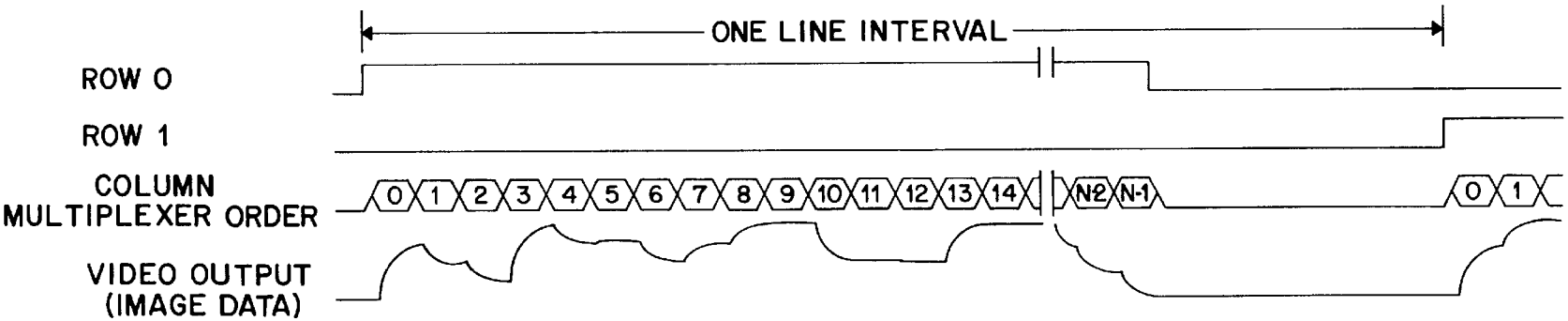

FIGS. 12*a* and 12*b* show timing diagrams that correspond to the schematic diagrams depicted in FIGS. 10 and 11. FIG. 12*a* spans an entire frame interval whereas FIG. 12*b* spans only one line interval. Only selected signals are shown in each timing diagram for clarity. In FIG. 12*a,* the first, second and last row selection signals are shown along with the associated sample/hold control signal and integrator reset signal. While a row selection signal is in a logical 1 state, the corresponding row of the light source is illuminated, otherwise it is not illuminated. When a Sample/Hold Control signal is in a logical 1 state, it is sampling or copying the input voltage to its own internal holding capacitor, otherwise its input is ignored and the holding capacitor voltage is maintained. When an Integrator Reset signal is in a logical 1 state, the reset switch is closed otherwise it is open. In FIG. 12*b,* the first, and a portion of the second, row selection signals are shown along with a representation of the columns selected by multiplexer and the corresponding analog video signal that represents the image data of the selected row, read out one column at a time.

Figure 13:
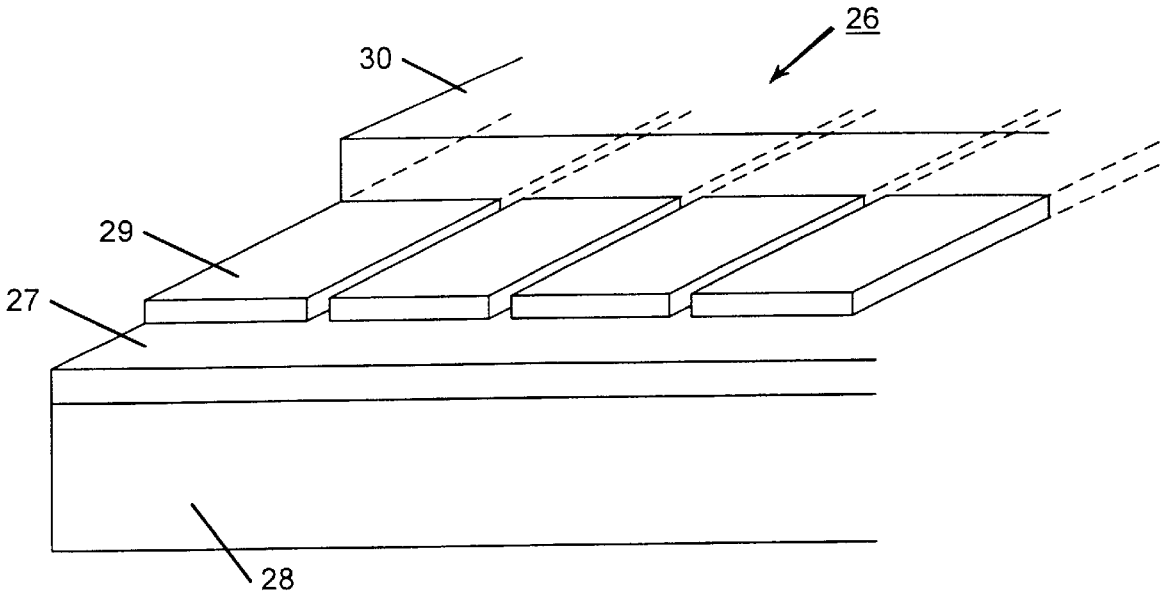
FIG. 13 is an isometric drawing of the target showing the columnar electrodes in accordance with a preferred embodiment of the present invention.
Figure 14:
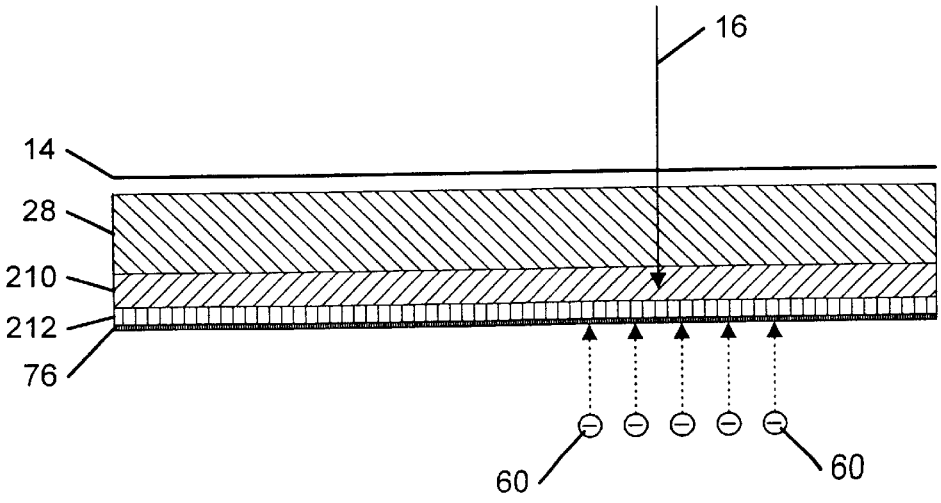
FIG. 14 is a detailed cross sectional view of the target showing the combination of a layer of radiation sensitive scintillator material and a layer of compatible photoconductive material.

FIG. 13 shows a portion of the target detailing the column oriented target electrodes 29 as they are deposited over an insulating barrier 27. The insulating barrier 27 is deposited as a layer on the substrate 28 which may or may not be metallic and therefore electrically conductive. If the substrate 28 exhibits sufficient electrical isolation, the insulating barrier 27 may be omitted. The photoconductor 30 is deposited as a layer over the columnar signal electrodes such that, for at least one edge, the electrodes 29 are allowed to extend beyond the photoconductor 30 thereby allowing electrical connection to be made with each of the column processor circuits. Preferably, the column electrodes and the substrate and insulating barrier are extended far enough to act as electrical feed throughs in the glass envelope 12 thereby allowing the electrical connections to the column processor circuits to be made in normal atmospheric pressure. FIG. 14 shows an alternate embodiment of the invention wherein the radiation sensitive photoconductor is replaced by a combination of a radiation sensitive scintillator 210 and a compatible photoconductor 212. The incident radiation 16 is absorbed by the scintillator material 210 which emits light localized to the point at which the photon 16 is absorbed. The light emitted by the scintillator 210 is absorbed by the light sensitive photoconductor 212 which behaves in substantially the same manner as the radiation sensitive photoconductor 30 described earlier in regard to the referred embodiment. To be effective, the light sensitive photoconductor must respond to the wavelength of light emitted by the scintillator layer 210.

There are numerous imaging applications for which the present invention is suitable. One such application, radiographic imaging, has two principal operating modes: static and dynamic (real-time). The following discussion of how the present invention operates in these two modes will best illustrate its functionality. Static mode radiographic imaging or radiography or radiographic spot imaging is performed for both medical and industrial applications.

In medical radiographic imaging, a patient is positioned between an x-ray generator and an x-ray imaging device. X-rays emitted by the generator pass through the body and are either absorbed, scattered or transmitted. The transmitted x-rays are recorded by the x-ray imaging device and an image of the body is acquired. The x-ray energies used are typically in the 40 kVp to 150 kVp range. Typically, in accordance with the prior art, the x-ray imaging device is a screen-film cassette, although other devices such as storage phosphors and flat-panel amorphous silicon based imagers have recently been developed.

Real-time radiographic imaging or fluoroscopy is performed in a similar manner except that motion picture images are acquired at a rate between 7.5 and 30 images per second using a continuous x-ray illumination. A variation of real-time radiographic imaging referred to as cinefluoroscopic imaging or simply cine, is also performed in a similar manner except that motion picture images are acquired at a rate between 15 and 90 images per second with an intermittent x-ray illumination. The x-ray imaging device required for fluoroscopy and cinefluoroscopy applications is typically an x-ray image intensifier.

In medical x-ray imaging applications, the radiation dose delivered to the patient as a result of the imaging process must be kept to a minimum. Consequently, the x-ray imaging device must be able to produce a high-quality image with minimal x-ray exposure. Typical input x-ray exposures (incident on the x-ray imaging device with a 9-inch diameter field of view) for medical fluoroscopic imaging applications are approximately 1 microRoentgen per image frame acquired. Cine requires about a 10 microRoentgen exposure dose per frame. Cine also differs from fluoroscopy in another fashion. Fluoroscopic images are acquired with a continuous low-intensity x-ray beam. Cine images are acquired with a pulsed x-ray beam so that motion artifacts which cause blurring are eliminated. Diagnostic or static radiography typically has a much higher exposure dose, around 300 microRoentgens per image.

In x-ray imaging applications, the sensitive area of the imaging device must be as large as the area to be imaged. For example, a cardiac imaging system that images the heart and surrounding tissue has an active area of 9 inches in diameter. A mammography system utilizes an 8-inch×10-inch active imaging area. There are a number of specialty medical disciplines that use image intensifiers with active areas of 12 inches to 16 inches in diameter. The largest area medical x-ray imaging application is chest or abdomen radiography where 14-inch×17-inch films are used.

An ideal x-ray imaging system should have the following characteristics: small form factor (e.g. flat like a film cassette), electronic readout (as opposed to film which must be scanned to provide digital images), high detection efficiency (>50%) and wide dynamic range (>1,000:1). For fluoroscopy applications the imaging system must also have low electronic read noise (below the quantum noise of the x-ray image) and fast readout (at least 30 frames per second). For radiographic imaging applications the imaging system must have high resolution (greater than 5 line pairs per millimeter). One of the most advantageous features of the present invention is that it is capable of performing all radiographic imaging modes—fluoroscopy (real-time/low dose), cine (real-time/medium dose) and spot radiography (static images/high dose)—while maintaining a flat, compact form factor.

In the present invention, x-rays are absorbed in a photoconductor producing a latent image in the charge stored on the surface of the photoconductor. As with all x-ray sensitive photoconductors, the electron-hole pairs produced from absorption of the incident x-rays are under the influence of an electric field applied normal to the surface and remain localized. Accordingly, extremely high-resolution images can be formed. The problem that most photoconductor-based x-ray imaging systems suffer from is that the read out mechanism severely limits the resolution of the displayed image. Although the image formed by the photoconductor is of high resolution, the resolution of the readout device is much lower.

For example, the selenium-based storage phosphor system utilizes an infrared laser to read the latent image. Due to thermal blooming effects, the smallest spot size that can be formed to read out the stored charge is on the order of 100 microns. For flat-panel amorphous silicon imaging systems that use a selenium photoconductor, the pixel pitch achievable is also on the order of 100 microns. A photoconductor-based x-ray imaging system that uses an array of cold cathode field emitters to read out the latent image is described in U.S. Pat. No. 5,567,929. This device also suffers from a lack of high resolution due to the spreading or dispersion of the electrons generated from the cold cathodes.

In the present invention, electrons that are produced from a photocathode read out the photoconductor. The photocathode is a photoemissive material and typically exhibits spatial resolutions comparable to that of photoconductors and is therefore an optimal read out source for photoconductive image sensors when high resolution is important. The photocathode can be illuminated by a variety of sources of light depending on the cost, form factor, intensity or resolution requirements desired. In the preferred embodiment, a high-brightness flat panel monochrome image display is proximity focused onto the photocathode. This configuration provides for a small form factor (a panel type detector). In an alternative embodiment, a laser is used to illuminate the photocathode and scans the entire area in a rectilinear or raster fashion. This embodiment is a lower cost alternative but requires a larger volume.

In the present invention, the photoconductor is initialized by first applying the desired target voltage to the photocathode electrode. This voltage will be transferred to the target and is determined by the x-ray dose associated with a given imaging application as well as the specific photoconductor used. The magnitude of the target voltage is chosen to ensure adequate dynamic range for the x-ray dose that is expected—a low x-ray dose requires a lower target voltage, conversely, a high dose requires a higher target voltage. Choosing too low a target voltage for a given x-ray dose may cause saturation of the image whereas having too high a target voltage may induce too much dark current in the photoconductor. The target voltage applied to the photoconductor must also be uniform everywhere on the target to ensure that the latent charge image is an accurate representation of the number of x-ray photons absorbed by the target at any given spot. (Any variation of target voltage, random or otherwise, prior to x-ray illumination can be misinterpreted as a variation of photon absorption during read out.) There may be circumstances however where it would be desirable to apply a non-uniform voltage to the photoconductor. For example, this might be done to compensate for nonuniformities in the photoconductor thickness that would otherwise superimpose an image brightness nonuniformity for a uniform x-ray illumination.

At the same time the voltage is applied to the photocathode electrode, a voltage is also applied to the mesh electrode and the target electrode is held at a nominal voltage level, preferably ground potential. For a typical application such as fluoroscopy, the photocathode voltage might be around 80 Volts and the mesh electrode voltage around +5,000 to 8,000 Volts depending on the spacing among the various electrodes within the enclosure.

A uniform electric charge, is then placed on the surface of the photoconductor by illuminating the photocathode with a light source. Light absorbed by the photocathode produces photoelectrons that are accelerated by the mesh electrode towards the photoconductor. Approximately half of the electrons accelerated toward the mesh electrode impact on the mesh and subsequently do not contribute to charging the photoconductor. The remaining electrons pass through the mesh electrode. As the electrons pass through the mesh electrode they begin to decelerate as they approach the surface of the photoconductor due to the electric field of the mesh electrode. These low velocity electrons approach the photoconductor and are deposited on the vacuum surface of the photoconductor creating the stored charge. The charge on the photoconductor accumulates until the potential on the photoconductor becomes equal to the voltage applied to the photocathode. Excess electrons are turned back to the mesh electrode. On the opposite surface of the photoconductor, electrons are liberated from atoms of the photoconductor and are conducted through the photoconductor electrode to ground completing the circuit. This results in the formation of a layer containing a number of electrons on one surface of the photoconductor and a like number of holes on the other.

For fluoroscopic imaging, the imaging system according to the present invention is initialized by placing a uniform charge on the photoconductor in the manner described above. X-rays transmitted through the patient are absorbed in the photoconductor. The absorbed x-rays produce electron-hole pairs in the photoconductor through Compton scattering and photoelectric events. Under the influence of the applied electric field the holes migrate to the vacuum surface of the photoconductor and neutralize the charge stored there and the electrons migrate towards the other surface and recombine with the holes stored there.

The amount of electron-hole pairs generated in the photoconductor during x-ray exposure is a function of the number and energy of the incident x-rays and the effective work function of the photoconductor. The effective work function is the amount of energy required to produce one electron-hole pair (ehp). In a photoconductor such as thallium-bromide, the effective work function is 6.5 eV. Accordingly, a 65 keV x ray will produce 10,000 electron-hole pairs in a thallium-bromide photoconductor. The amount of charge neutralized by the holes is a function of the amount of charge stored and the material properties of the photoconductor.

The photoconductor must have a high resistivity, low trapping site density and a low dark current to be an effective photoconductor for x-ray imaging applications. Low resistivity and/or high dark current will result in premature discharge of the stored charge. High trapping site density will prevent holes from migrating to the surface and producing the desired latent image.

During the x-ray exposure encountered with a fluoroscopic imaging application, the x-rays are impinging on the photoconductor at a constant but relatively low rate. In accordance with the present invention, the charge accumulating on the photoconductor is read out 30 times per second. This is accomplished by turning on one row of pixels contained in the high brightness flat panel display. The light produced by the row of pixels illuminates the photocathode producing a planar beam of electrons that are accelerated towards the mesh electrode and decelerated towards the photoconductor surface. This planar beam covers an area on the target one pixel high by N-pixels wide where N is the number of pixels in the row (and accordingly the number of column electrodes). In accordance with a preferred embodiment of the present invention N is 1,024.

Each row of pixels on the high-brightness display panel is turned on for a period of time equal to 1/Mth of the duration of a single image frame where M is the number of rows. In accordance with a preferred embodiment of the present invention M is 1,024. For 30-frame per second image acquisition, the frame time is 1/30th of a second. Therefore, each row of pixels is turned on for approximately 30 microseconds. This process is repeated M times during a single frame reading out the entire surface of the photoconductor and repeated for each image frame acquired.

Referring to FIG. 10, during the 30-microsecond period that each row of pixels is illuminated, the charge that was neutralized by the absorbed x-rays is restored on the photoconductor. This causes a current to flow in each of the column-oriented electrodes Col 0-Col N-1 of the target that is proportional to the amount of charge previously depleted by the absorbed x rays in the pixel. Here, a pixel P(0,0)-P (M-1,N-1) is the area subtended by the row-oriented electron beam and the column-oriented target electrode. The current flowing in each of the column electrodes is converted to a voltage by a transimpedance amplifier 192 and stored on an integration capacitor 194. In this manner the charge produced by the absorbed x-rays is sensed as a current, converted into a voltage and stored on a larger integrating capacitor producing a signal gain with improved signal-to-noise properties.

At the end of the 30-microsecond period i.e. the line-time, the signal data stored at each of the N column electrodes is available for transfer. Accordingly, target charge for an area corresponding to the row just read has been restored to its initialized state thereby making this portion of the target ready to accumulate more x-ray induced charge. In fluoroscopic x-ray imaging the x-ray dose is delivered continuously, therefore, as soon as the row just read has had its initializing charge restored, x-rays may be absorbed in that area of the target and begin to neutralize the charge thereby beginning anew the latent image formation process. In this manner, each row, Row 0 through Row M-1, is guaranteed to be read out once per frame.

Prior to beginning the next row read-out cycle, the signal data corresponding to the current row must be somehow stored because the integrating capacitors associated with each column electrode of the target must be discharged or cleared. Clearing each column integration capacitor is necessary to ensure that the signal collected from each pixel reflects only the amount of charge neutralized by incoming x-rays. A single line time (30-microseconds) may be allocated to the serial read out of the N columns associated with a given line (i.e. pixel at a time in sequence). Then, each pixel will require on the order of 25–30 nanoseconds, which implies a reasonable video data rate of 33–40 megahertz. In accordance with a preferred embodiment of the current invention, at the end of each line-time, the voltage held on each column integration capacitor is transferred to a separate sampling circuit 198 in preparation for serial transfer during the succeeding line-time by the multiplexer 200. Also, at the end of the present line-time, the integration capacitor is cleared or reset by the reset switch 196 after the voltage is transferred i.e. copied to the holding capacitor. (See FIGS. 10, 11 and 12.) Consequently, while any given line is being read out and its target voltage restored, the previous lineIs image data is being serially transferred from the imager to some other device such as a video monitor for immediate display or to a computer for digitization and subsequent storage and/or display. Synchronization of the PPI to an external device such as a cathode ray tube type video monitor or a computer may also require an idle period between frames to allow the external device to prepare for the next frame. Although the PPI does not require an idle period between frames to operate, this could be readily accommodated by driving the high brightness display to operate at a line rate of N+n lines per frame where n is the number of additional line-times needed for the external device to prepare for the next frame. Anyone knowledgeable in the art of video imaging can establish a suitable timing to synchronize the PPI with video display, recording or digitizing devices.

The application of the present invention to static-image capture or radiographic spot imaging is similar to fluoroscopy described above with the following changes. First, the x-ray dose is significantly higher—typically 300 microRoentgens per image vs. 1 microRoentgen per image for a 9" diameter imager. Consequently, the voltage applied to the photocathode would be higher to accommodate the charge neutralizing effect of the higher x-ray dose. The exact voltage is chosen by the user based on the x-ray entrance dose and the type of photoconductor used. Also, to ensure that the target can be fully recharged in the allotted line-time, the light intensity from the high brightness light source would be increased to ensure sufficient electron emission from the photocathode. Second, the x-ray dose is completely applied prior to reading out the image. That is, the latent image is fully formed prior to read out unlike fluoroscopic imaging where latent image formation and read out are occurring simultaneously. This is done to allow for longer exposure times to accumulate sufficient dose for a high quality image i.e. low x-ray quantum noise. In the current invention this is accomplished by first charging the target in the same way that a single frame of fluoroscopy is charged i.e. target initialization. After the target is uniformly charged, the x-ray exposure is made thereby forming the latent image on the photoconductor. After the latent image is formed, the high brightness light source is turned on to read out the image by scanning the entire target once. In accordance with the preferred embodiment, the target initialization and image read out for radiographic spot images would be accomplished one line at a time (the same as for fluoroscopic read out.)

Typical radiographic spot image exposure times may extend from a few tens of milliseconds to hundreds of milliseconds depending on the density and nature of the object to be imaged and the power handling capability of the x-ray generator. Regardless of the exposure time i.e. the time provided for the formation of the latent image, the read out time can be as quick as 1/30th of a second provided that the combination of the high brightness light source and the photocathode can provide sufficient current to the photoconductor to recharge it. In the event that the light output of the light source and/or the photocathode conversion efficiency is insufficient, the time allotted to read out each line could be extended to compensate. This is generally an appropriate way to ensure complete recharge of the photoconductor as long as the selected photoconductor exhibits a sufficiently low dark current such that the contribution of dark current during the lengthened read out period would be negligible.

The application of the present invention to cinefluoroscopic imaging is also similar to the method used for fluoroscopic imaging with the following changes. First, the x-ray dose for cine is higher by a factor of 10× to 20×. The higher dose of cine imaging vs. fluoroscopic imaging can be accommodated in the same manner that the higher dose of radiographic imaging is handled. Second, the cine x-ray dose is pulsed once per frame, usually for a per frame duration of 3–5 milliseconds during the vertical blanking interval. The vertical blanking interval is a time period of typically several milliseconds between frames required by cathode ray tube (CRT) display devices. The PPI does not require a vertical blanking period to operate but could always accommodate such an idle period between frames to suit cinefluoroscopic imaging applications. Introduction of an idle period between frames is readily accomplished by controlling the timing signals to the high brightness light source that drives the PPI and is obvious to anyone familiar with video imaging and display devices.

While the invention has been described in connection with certain presently preferred embodiments thereof, those skilled in the art will recognize that many modifications and changes may be made therein, without departing from the true spirit and scope of the invention, which accordingly is intended to be defined solely by the appended claims.

What is claimed:

1. A high resolution radiation sensitive imager comprising:

a radiation sensitive photoconductive target, for forming an image in response to incident radiation;

a light sensitive photocathode arranged in spaced apart relationship with the target;

a light source coupled to the photocathode for causing the photo cathode to emit electrons for addressably reading an image formed on the target.

2. The imager of claim 1 comprising a vacuum envelope enclosing the photoconductive target and the photocathode.

3. The imager of claim 1 comprising an electrode disposed between the photo cathode and the target for accelerating electrons from the photo cathode towards the target.

4. The imager of claim 3 in which the electrode comprises a wire mesh.

5. The imager of claim 1 in which the photo conductive target comprises a radiation transmissive substrate, and a layer of radiation sensitive photo conductive material on the substrate.

6. The imager of claim 5 in which the radiation comprises x-rays, and the radiation sensitive material is selected from the group consisting of selenium, thallium bromide, thallium iodide, lead iodide, and lead bromide.

7. The imager of claim 6 in which the light sensitive photocathode comprises a layer of antimony combined with an alkali metal.

8. The imager of claim 1 comprising an amplifier connected to the target.

9. The imager of claim 8 in which the amplifier is connected to measure the current flowing between the photo cathode and the target.

10. The imager of claim 1 in which the light source comprises a generally flat two dimensional display.

11. The imager of claim 10 in which the display comprises a liquid crystal display.

12. The imager of claim 10 in which the display comprises a field emission display.

13. The imager of claim 10 in which the display comprises an electroluminescent display.

14. The imager of claim 10 in which the display comprises a plasma flat panel display.

15. The imager of claim 1 in which the target comprises a plurality of segments readable in parallel.

16. The imager of claim 1 in which the light source comprises a line of high resolution light sources, and means for mechanically translating the line of light sources relative to the photo cathode.

17. The imager of claim 1 in which the target comprises a line target, and the light source comprises a line of high resolution light sources, and also comprising means for translating the object relative to the target.

18. The imager of claim 1 in which the light source is a different size from the photo cathode, and comprising focusing means for imaging the light source on the photo cathode.

19. The imager of claim 1 in which the light source comprises a scannable laser having a wavelength matched to the photo cathode.

20. The imager of claim 1 in which the light source comprises a scannable laser having a characteristic wavelength that causes emission of electrons by the photocathode.

21. The imager of claim 1 in which at least one of the photoconductive target, the photocathode and the light source comprises a plurality of addressable segments.

22. A method of producing an x-ray image comprising:

placing a charge on an x-ray sensitive photoconductor;

producing an x-ray field having sufficient intensity and energy to penetrate an object and produce a latent image on said photoconductor;

exposing said object to be imaged to said x-ray field;

exposing said photoconductor to said x-ray field from said object such that said x-ray field interacts with said photoconductor to produce said latent image;

reading out said photoconductor with electrons produced from a photocathode source;

exposing said photocathode source from a light source.

23. A method according to claim 22 comprising producing fluoroscopic images at a rate of 7.5 to 30 frames per second.

24. A method according to claim 22 comprising producing cinefluorographic images at a rate greater than 15 frames per second.

25. A method of reading out a latent image stored as a pattern of charge on a radiation sensitive photoconductor comprising restoring the charge with electrons produced from a photocathode illuminated by a light source.

26. A method of detecting an image comprising;

forming a latent image on a photoconductor;

illuminating a light sensitive photocathode to produce electrons;

accelerating the electrons from the photocathode so that they impinge on the photoconductor;

measuring the current between the photocathode and the photoconductor to create an electrical signal corresponding to the latent image on the photoconductor.

27. The method of detecting an image of claim 26 in which the step of illuminating a light sensitive photocathode comprises addressably illuminating the photocathode.

28. The method of detecting an image of claim 27 in which the step of addressably illuminating the photocathode comprises sequentially illuminating adjacent rows/columns of the photocathode.

29. The method of detecting an image of claim 28 in which the step of measuring the current between the photocathode and the photoconductor comprises sequentially measuring the current in adjacent columns/rows of the photoconductor.

30. The method of detecting an image of claim 26 in which the step of accelerating the electrons from the photocathode so that they impinge on the photoconductor comprises accelerating the electrons from the photocathode towards an accelerating grid, and then decelerating the electrons so that they impinge on the photoconductor with a relatively low energy.

31. The method of detecting an image of claim 26 in which the step of illuminating a light sensitive photocathode comprises sequentially illuminating the photocathode with a spot of light.

32. The method of detecting an image of claim 31 in which the step of sequentially illuminating the photocathode with a spot of light, comprises illuminating the photocathode with a laser.

33. The method of detecting an image of claim 26 in which the step of sequentially illuminating the photocathode comprises illuminating the photocathode with an addressable generally flat light source.

34. The method of detecting an image of claim 33 in which the step of sequentially illuminating the photocathode comprises illuminating the photocathode with a cathode ray tube.

35. A high resolution radiation sensitive imager comprising:

a radiation sensitive photoconductive target, for forming an image in response to incident radiation;

a light sensitive photocathode arranged in spaced apart relationship with the target;

an addressable light source coupled to the photocathode for causing the photocathode to emit electrons for reading an image formed on the target.

36. The high resolution radiation sensitive imager of claim 35 in which the radiation sensitive photoconductive target comprises a plurality of elongated electrodes.

37. The high resolution radiation sensitive imager of claim 36 comprising a row selector circuit connected to the light source.

38. The high resolution radiation sensitive imager of claim 37 comprising a plurality of column processors connected to the radiation sensitive photo conductive target.

39. The high resolution radiation sensitive imager of claim 38 comprising a column multiplexer connected to the plurality of column processors.

40. The high resolution radiation sensitive imager of claim 39 in which each of the column processors comprises a transimpedance amplifier.

41. The high resolution radiation sensitive imager of claim 40 in which each of the column processors comprises an integrating capacitor connected to the transimpedance amplifier.

42. The high resolution radiation sensitive imager of claim 41 in which each of the column processors comprises a sampling circuit connected to the integrating capacitor.

43. The imager of claim 1 in which the target comprises a segmented line target, and the light source comprises a line source, and also comprising means for translating the object relative to the target.

44. The high resolution radiation sensitive imager of claim 35 in which the light sensitive photocathode comprises a plurality of elongated electrodes.

* * * * *